US012471623B2

(12) United States Patent
Vasquez

(10) Patent No.: US 12,471,623 B2
(45) Date of Patent: Nov. 18, 2025

(54) SMOKING TIP WITH SELECTIVELY INFUSED FLAVOR CHAMBER

(71) Applicant: Miguel Humberto Vasquez, San Angelo, TX (US)

(72) Inventor: Miguel Humberto Vasquez, San Angelo, TX (US)

( * ) Notice: Subject to any disclaimer, the term of this patent is extended or adjusted under 35 U.S.C. 154(b) by 0 days.

(21) Appl. No.: 19/061,291

(22) Filed: Feb. 24, 2025

(65) Prior Publication Data

US 2025/0268296 A1 Aug. 28, 2025

Related U.S. Application Data

(60) Provisional application No. 63/556,427, filed on Feb. 22, 2024.

(51) Int. Cl.
*A24D 3/04* (2006.01)
*A24D 3/02* (2006.01)

(52) U.S. Cl.
CPC ..... *A24D 3/048* (2013.01); *A24D 3/022* (2013.01); *A24D 3/0229* (2013.01)

(58) Field of Classification Search
None
See application file for complete search history.

(56) References Cited

U.S. PATENT DOCUMENTS

| | | | | |
|---|---|---|---|---|
| 11,076,632 | B1 * | 8/2021 | Ormaza | A24C 5/56 |
| 11,793,232 | B1 * | 10/2023 | Almonte | A24D 1/002 |
| 11,864,583 | B1 | 1/2024 | Almonte | |
| 2012/0138075 | A1 * | 6/2012 | Jespersen | A24F 15/12 131/331 |
| 2021/0352957 | A1 * | 11/2021 | Mousson | A24D 1/045 |
| 2023/0110370 | A1 | 4/2023 | Wahidi | |
| 2023/0232893 | A1 | 7/2023 | Jesperson et al. | |

FOREIGN PATENT DOCUMENTS

WO 2023112885 A1 6/2023

OTHER PUBLICATIONS

International Search Report and Written Opinion by ISA/US of PCT/US25/17029 dated Apr. 23, 2025.

* cited by examiner

*Primary Examiner* — Dennis R Cordray
(74) *Attorney, Agent, or Firm* — Outlier Patent Attorneys, PLLC

(57) ABSTRACT

A smoking tip filter with a central channel infused with consumable flavorants, surrounded by non-infused paper layers. A barrier prevents diffusion beyond the channel. Inserting into a smoking device flavors smoke via central channel contact only, without burning additives. Enables enjoyable tailored flavors; avoids harsh tastes or paper contamination.

10 Claims, 5 Drawing Sheets

SMOKING TIP WITH SELECTIVELY INFUSED FLAVOR CHAMBER

CROSS-REFERENCE TO RELATED APPLICATIONS

This Application claims priority to U.S. Provisional Patent Application No. 63/556,427 filed on Feb. 22, 2024, entitled "IMPROVED SMOKING TIP WITH SELECTIVELY INFUSED FLAVOR CHAMBER", the contents of which are incorporated herein by reference.

BACKGROUND

Field of Art

The present invention relates generally to smoking devices and accessories and, more particularly, to a selectively infused and flavored filter tip for use in hand-rolled smoking devices to improve the flavor profile delivered to the user.

Discussion of the State of the Art

Smoking devices such as hand-rolled cigarettes or premade cones typically utilize paper tips or filters to prevent loose smoking material from being drawn into the smoker's mouth. However, these paper filters impart an unappealing cardboard-like flavor that diminishes the intended flavors of the smoking substances.

A number of approaches have attempted to address the undesirable cardboard flavor imparted by standard paper filters and tips. Some products infuse the rolling paper with additional flavors, but burning the flavored papers during smoking introduces a harsh, chemical taste. Other available filter products aim to provide flavor, but require the user to crush an enclosed liquid-filled capsule prior to use. This can be inconvenient and still imparts a burnt flavor.

In summary, current solutions for improving the flavor of paper filters and tips have a number of drawbacks. Infusing the entire rolling paper with flavor additives leads to an unpleasant burnt chemical taste when smoked. Enclosed capsule filters require an extra preparation step and do not fully mitigate the cardboard flavor. As such, there exists a need for a smoking filter or tip that effectively delivers intended flavors without imparting unwanted tastes to the smoker. An optimal solution would avoid complicated preparation, burning additional chemicals, and having to compromise on intended flavors.

SUMMARY

The present invention discloses a flavored smoking tip that effectively enhances and delivers intended flavors without imparting undesirable burnt or cardboard tastes. This is achieved by selectively infusing a flavorant only within a section of the filter tip that avoids direct burning.

Specifically, a smoking tip is comprised of a paper that can be rolled into a cylindrical-shaped rolled paper filter that has an inner end section that interfaces with the smoking substance. This inner section is infused with a consumable terpene or other flavorant additive. During smoking, the flavorant saturates only the central filter section directly exposed to the smoke, and does not coat the outer paper layers that combust.

The inner infused section acts as a barrier to prevent the terpenes or flavorants from bleeding into the other non-infused filter paper layers. This isolated delivery system prevents burning the flavorants directly and exposing the user to an unpleasant chemical aftertaste. It also avoids imparting a cardboard paper flavor to the smoke by instead infusing the central stream with enhanced flavors.

Perforated edges along the interface between the inner infused filter section and outer paper layers assist with confinement and separation of the flavorant. This perforation barrier limits diffusion outward. Various flavorants tailored to the smoking substance can be introduced.

In summary, selectively infusing terpenes or flavorants only within an isolated portion of the filter tip delivers enhanced flavors to the user via central smoke exposure, while avoiding chemical burning of the flavorant additive or imparting cardboard tastes from the paper itself. The perforation barrier assists with separation and isolation within the filter.

The invention may comprise a filter paper having a length and a width that can be rolled for forming a smoking tip in a hand-rolled smoking article, the filter paper comprising: five arrays of columns that are separated by perforations that extend continuously across the entire width of the filter paper, the arrays spanning a portion of the length of the filter paper; two of the five arrays forming an infused section, the infused section being infused with a flavorant additive, the two infused arrays being adjacent to each other; three of the five arrays forming a barrier section, the barrier section being unflavored, the three barrier arrays being adjacent to each other; and an unflavored section disposed adjacent to the barrier section on the filter paper such that the barrier section is disposed between the infused section and the unflavored section, whereby the perforations impede capillary action preventing the flavorant additive from migrating laterally from the flavored section into the unflavored section when the filter paper is in a un-rolled configuration, wherein the paper is folded at each perforation before being rolled into a smoking apparatus. Furthermore, the flavorant additive is comprised of at least one of natural terpenes, synthetic food-grade flavorants, essential oils, and/or mixtures thereof. The perforations are formed by laser etching to achieve a predetermined perforation density and pattern that balances the prevention of lateral capillary action with structural integrity. The barrier section comprises a composite laminated interface having: an inner non-porous polymer film layer, and an outer filter paper layer treated with a hydrophobic compound, configured to further impede the flavorant additive from migrating into the unflavored section. The two infused arrays within the infused section are infused with the flavorant additive via a pressure-injection process and subsequently dried or cured to stabilize the flavorant additive. The flavored section, barrier section, and unflavored section extend along the paper such that, when the paper is subsequently folded along each perforation and then rolled to form a cylindrical smoking tip, the flavored section forms an interior channel isolated from the outer combustible unflavored section by the barrier section. Additionally, the invention comprises a method of manufacturing a filter paper for forming a smoking tip in a hand-rolled smoking article, the method comprising: providing an elongated paper web in an unrolled configuration having a length and a width; forming five arrays of columns that span a portion of the length of the paper web, the five arrays being separated by perforations that extend continuously across the entire width of the paper web; infusing two adjacent arrays of the paper web with a flavorant additive to form an infused section; designating three adjacent arrays as a barrier section, said barrier section remaining unflavored and disposed between the infused section and an unflavored section on the paper web; ensuring the perforations are sufficient to impede capillary action of the flavorant additive from migrating into the barrier section and the unflavored section; and folding the paper web along each perforation prior to rolling the filter paper into a smoking tip, whereby the perforations prevent the flavorant additive from migrating laterally from the infused section to the unflavored section when in the unrolled configuration. The invention may further comprise pressure-injecting the flavorant additive into the two adjacent arrays and subsequently drying or curing the infused arrays to stabilize the flavorant additive prior to folding and rolling. The invention may further comprise laminating at least a portion of the barrier section with a composite interface including a non-porous polymer film layer and a hydrophobically treated filter paper layer, thereby enhancing the barrier against flavorant migration. Forming the perforations comprises laser etching the paper web to achieve a predetermined perforation pattern that balances structural integrity with the prevention of lateral flavorant migration.

BRIEF DESCRIPTION OF THE DRAWING FIGURES

The accompanying drawings (if any) illustrate several embodiments and, together with the description, serve to explain the principles of the invention according to the embodiments. It will be appreciated by one skilled in the art that the particular arrangements illustrated in the drawings are merely exemplary and are not to be considered as limiting of the scope of the invention or the claims herein in any way.

DETAILED DESCRIPTION OF EMBODIMENTS

Figure 1:
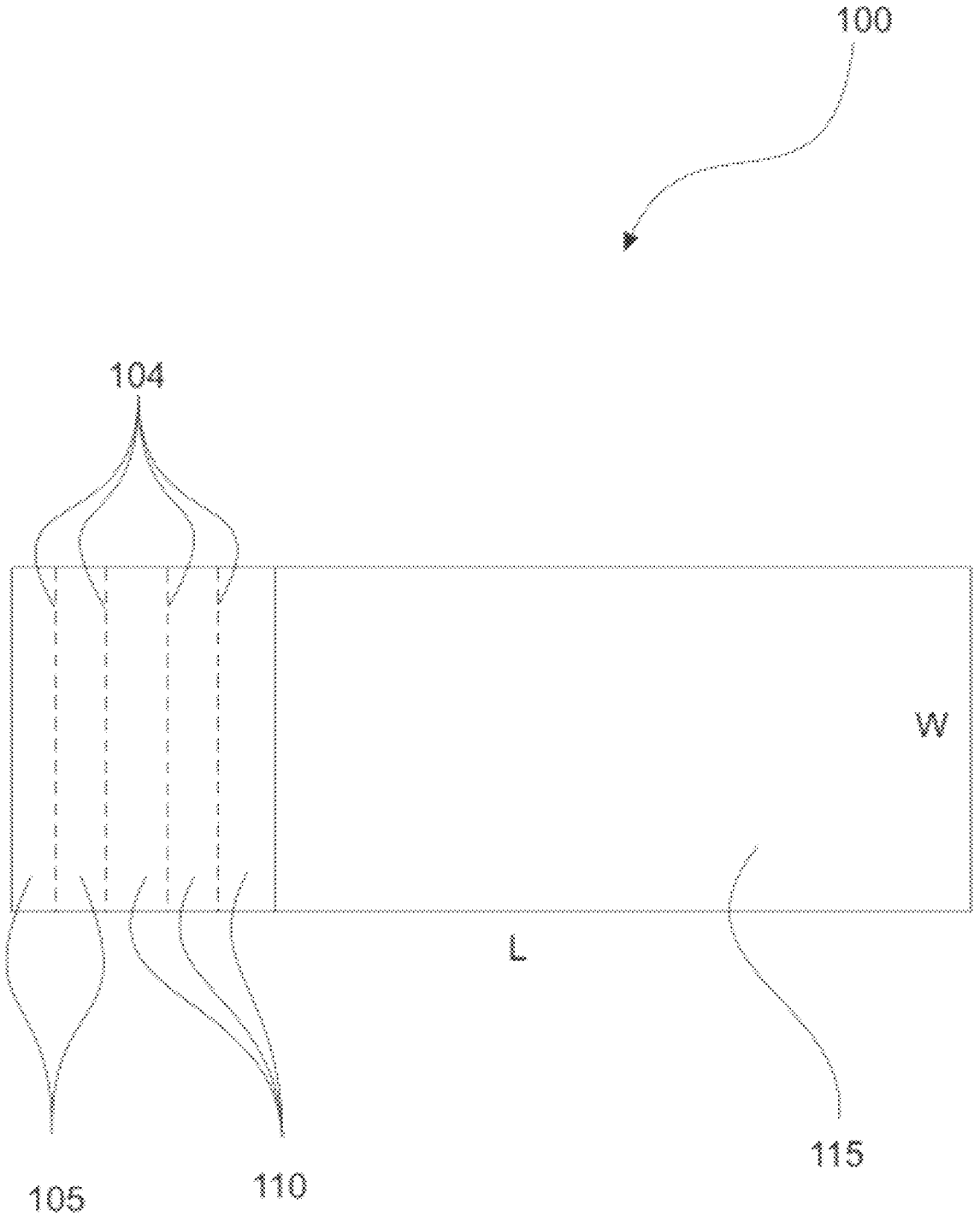
FIG. 1 illustrates an unrolled view of an embodiment of the present invention.

The present invention is for an improved smoking tip with selectively infused flavor chamber. The invention is described by reference to various elements herein. It should be noted, however, that although the various elements of the inventive apparatus are described separately below, the elements need not necessarily be separate. The various embodiments may be interconnected and may be cut out of a singular block or mold. The variety of different ways of forming an inventive apparatus, in accordance with the disclosure herein, may be varied without departing from the scope of the invention.

Generally, one or more different embodiments may be described in the present application. Further, for one or more of the embodiments described herein, numerous alternative arrangements may be described; it should be appreciated that these are presented for illustrative purposes only and are not limiting of the embodiments contained herein or the claims presented herein in any way. One or more of the arrangements may be widely applicable to numerous embodiments, as may be readily apparent from the disclosure. In general, arrangements are described in sufficient detail to enable those skilled in the art to practice one or more of the embodiments, and it should be appreciated that other arrangements may be utilized and that structural changes may be made without departing from the scope of the embodiments. Particular features of one or more of the embodiments described herein may be described with reference to one or more particular embodiments or figures that form a part of the present disclosure, and in which are shown, by way of illustration, specific arrangements of one or more of the aspects. It should be appreciated, however, that such features are not limited to usage in the one or more particular embodiments or figures with reference to which they are described. The present disclosure is neither a literal description of all arrangements of one or more of the embodiments nor a listing of features of one or more of the embodiments that must be present in all arrangements.

Headings of sections provided in this patent application and the title of this patent application are for convenience only and are not to be taken as limiting the disclosure in any way.

Devices and parts that are connected to each other need not be in continuous connection with each other, unless expressly specified otherwise. In addition, devices and parts that are connected with each other may be connected directly or indirectly through one or more connection means or intermediaries.

A description of an aspect with several components in connection with each other does not imply that all such components are required. To the contrary, a variety of optional components may be described to illustrate a wide variety of possible embodiments and in order to more fully illustrate one or more embodiments. Similarly, although process steps, method steps, or the like may be described in a sequential order, such processes and methods may generally be configured to work in alternate orders, unless specifically stated to the contrary. In other words, any sequence or order of steps that may be described in this patent application does not, in and of itself, indicate a requirement that the steps be performed in that order. The steps of described processes may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to one or more of the embodiments, and does not imply that the illustrated process is preferred. Also, steps are generally described once per aspect, but this does not mean they must occur once, or that they may only occur once each time a process, or method is carried out or executed. Some steps may be omitted in some embodiments or some occurrences, or some steps may be executed more than once in a given aspect or occurrence.

When a single device or article is described herein, it will be readily apparent that more than one device or article may be used in place of a single device or article. Similarly, where more than one device or article is described herein, it will be readily apparent that a single device or article may be used in place of the more than one device or article.

The functionality or the features of a device may be alternatively embodied by one or more other devices that are not explicitly described as having such functionality or features. Thus, other embodiments need not include the device itself.

Techniques and mechanisms described or referenced herein will sometimes be described in singular form for clarity. However, it should be appreciated that particular embodiments may include multiple iterations of a technique or multiple instantiations of a mechanism unless noted otherwise. Alternate implementations are included within the scope of various embodiments in which, for example, functions may be executed out of order from that shown or discussed, including substantially concurrently or in reverse order, depending on the functionality involved, as would be understood by those having ordinary skill in the art.

Apparatus

The apparatus of the present invention is comprised of a combustible filter paper that can be rolled to form a smoking tip in a hand-rolled smoking article. The elements individually or in combination provide the benefits described above.

Referring to FIG. 1, the filter paper 100 in an unrolled configuration includes five arrays of columns illustrated as flavorant-infused longitudinal regions 105 and barrier longitudinal regions 110, extending across the width W of the paper. The arrays together span a portion of the paper's length L and are separated by perforations 104 that likewise extend continuously across the entire width W of the filter paper. Two of the five arrays constitute a flavored or infused section, while three arrays constitute a barrier section, adjacent to an unflavored section.

Flavor Infused Section 105

As shown in the figures, in one embodiment the invented filter paper 100 comprises an flavorant-infused longitudinal regions 105. The flavorant may comprise terpenes or other consumable flavorants, including but not limited to essential oils and food-grade synthetic flavors.

In this embodiment, the flavorant additive is pressure-injected into flavorant-infused longitudinal regions 105. These two adjacent arrays collectively form the infused section, which is subsequently cured or dried to stabilize the flavorant additive. Various natural terpenes or food-grade synthetic flavorants are suitable depending on the targeted flavor profile. Infusion concentrations can be tailored to achieve desired potency.

The flavorant-infused longitudinal regions 105 are separated from the barrier longitudinal regions 110 by perforations 104 that prevent capillary migration of the flavorant. Thus, the flavorant remains localized to flavorant-infused longitudinal regions 105 during storage, handling, and subsequent rolling of the paper into a smoking tip.

In one embodiment, the flavorant additive is introduced by a controlled pressure infusion or injection process, ensuring that the additive is localized only within the designated central channel. This selective infusion prevents over-saturation of the paper and maintains the intended flavor profile during smoking.

In order to turn the paper into a smoking apparatus, it is folded along each of the perforations and then rolled with a smoking substance placed within the unflavored section 115. The flavorant-infused longitudinal regions 105 form the innermost channel within the cylinder formed by rolling the paper 100. When smoke passes through the innermost channel, it contacts the flavorant-infused longitudinal regions 105 and imparts a flavor to the smoke before it is inhaled. The barrier longitudinal regions 110 forms a barrier to prevent the flavorant-infused longitudinal regions 105 from touching the unflavored section 115 and thereby preventing the flavorants from seeping into the unflavored section 115.

Numerous configurations for isolating the infused flavorant-infused longitudinal regions 105 are possible. While a barrier longitudinal regions 110 separated by perforations 104 is shown, alternative edge treatments may prevent bleeding of the terpenes into adjacent filter paper such as ablation, intruded divots, non-porous coatings, or water-resistant compounds along the barrier longitudinal regions 110 surrounding the flavorant-infused longitudinal regions 105. The flavorant-infused longitudinal regions 105 can be created through pressure infusion or injection of terpenes rather than simple soaking/adsorption. Various terpene mixtures customized to the smoking material can be utilized. Additional processing steps, such as curing or controlled drying, may be applied immediately following infusion to stabilize the flavorant additive and to ensure uniform distribution within the central channel.

The dimensions, paper composition, shape configurations, and infusion concentrations described herein are preferred, though it should be understood that considerable variability in conformance with the invention is possible. The inventive concept lies in the selective introduction of flavorants into the central filter section exposed directly to smoke, preventing terpenes from contacting and burning with external paper and preventing cardboard paper contamination of smoke channeling through the flavored central filter chamber.

Barrier 110

Three barrier longitudinal regions illustrated as 110 form the barrier section, which is left unflavored to inhibit the lateral migration of the flavorant additive from the flavorant-infused longitudinal regions 105 into the unflavored section 115. The presence of perforations 104 at each boundary interface between the arrays further prevents the flavorant from wicking or diffusing into adjacent arrays.

In some embodiments, the barrier section is reinforced with additional coatings or materials to further impede flavor migration. For example, a composite laminated interface can be applied, comprising an inner non-porous polymer film, an outer hydrophobically-treated filter paper layer, or a combination thereof.

These three arrays within the barrier longitudinal regions 110 are disposed contiguously, with each interface separated by a perforations 104 that extends across the width W of the filter paper.

In a rolled configuration, the barrier longitudinal regions 110 serves to contain the terpenes or flavorants within the flavorant-infused longitudinal regions 105, preventing saturation of adjacent unflavored section 115. As smoke passes primarily through the flavorant-infused longitudinal regions 105 during use, the barrier longitudinal regions 110 maintains separation so that smoke contacts infused flavorings while the unflavored section 115 avoiding burning.

In an embodiment, the barrier longitudinal regions 110 comprises a perforated interface made of the base filter paper material that compartmentalizes the flavorant-infused longitudinal regions 200. The perforations are small slits, holes, or scored lines made through one paper layer allowing restricted flow outward. The barrier density and shape can be tailored to dial in desired terpene diffusion rates for manufacturing considerations.

According to one embodiment, the barrier longitudinal regions 110 is a composite laminated interface comprising an inner layer of a non-porous polymer film (such as polyethylene or polypropylene) and an outer layer of filter paper that has been treated with a hydrophobic compound (for example, a wax or siloxane-based treatment). This composite barrier is designed to be impervious to the flavorant additive, thereby preventing lateral diffusion into the unflavored section 115.

In a specific embodiment, controlled perforations are created using laser etching, which allows for precise control of the perforation size and distribution. This controlled perforation pattern permits sufficient smoke flow for flavor delivery while maintaining the barrier's effectiveness in preventing flavorant migration.

Alternatively, barrier materials can include non-porous paper, celluloses, or polymers laminated along the filter seam to prevent fluid movement between compartments. Examples include wax paper, corn zein protein films, extruded polyethylene sheets, or other materials resistant to terpene absorption applied as a longitudinal strip or wrapper. Additionally, the infused and non-infused sections can be bonded using thermal heat, laser welding, ultrasonic acoustics focused along the compartment boundary to induce material fusion or densification to restrict seepage.

Chemical additives can also act as barrier agents, including introducing hydrophobic compounds like siloxanes, petroleum jelly or inorganic salts proximal to the flavorant chamber. Equally, cross-linking agents such as aldehydes or other reactive compounds can densify cellulose fibers along the filter paper seam to prevent wicking. Combined physical, chemical and thermal techniques can produce integrated barriers with multi-modal functionality. Barrier width, porosity, and seam overlaps can be optimized to sufficiently separate the central infused chamber while preventing manufacturing difficulties.

Unflavored Section

At least one additional section, the unflavored section 115 is disposed adjacent to the barrier longitudinal regions 110. This unflavored section 115 comprises conventional or modified filter paper without flavorant additives.

A variety of materials may be used for the unflavored section 115, including conventional cellulose fiber paper, absorbent cotton fibers, or bundled synthetic polymer fibers. The thickness, density, and filtration properties can be adapted based on the targeted contaminant removal and desired smoking experience.

When the filter paper 100 is folded along the perforations and then rolled, the flavorant-infused longitudinal regions 105 become the innermost portion of the final smoking tip, while the barrier longitudinal regions 110 remain interposed between the infused section and the unflavored section 115. This configuration ensures that the flavorant additive in the flavorant-infused longitudinal regions 105 does not bleed through the barrier section into the unflavored section. The unflavored sections 115 comprise the majority of the smoking tip filter length surrounding the flavorant-infused longitudinal regions 200 (when the paper is in a rolled configuration). The base filter paper material provides the underlying structure and shape into which flavorants are infused into the central channel 200.

A variety of filtration materials may be used for the unflavored sections 115, including conventional cellulose fiber filter paper, absorbent cotton fibers, or bundled synthetic polymer fibers. The thickness, density and filtration properties can be adapted based on the targeted contaminant removal and desired smoking experience. More porous, thicker papers allow higher airflow while denser packing captures more particles and residues.

Various filter paper shapes facilitate inclusion of a central infused channel 200. While conical and cylindrical shapes are preferred, bifurcated, rounded, or multifaceted filters are also possible configurations. The dimensions, length, diameter, and packing density of the filter can be manufactured as desired to work with standard smoking paper diameters. Biodegradable and renewable paper sources are ideal materials given single-use applications.

Additionally, the base filter material can incorporate additional adsorbent, reactive substances to remove specific smoke components if desired. Embedded activated carbon granules, acidic clay minerals, dynamic precipitation agents, or other sorptive media can combine with the flavorant-infused longitudinal regions 105 if specific chemical filtration is needed. These provide adjustable filtration without altering key terpene infusion aspects.

Alternating layers of multi-density paper or composite filters combining cellulose and functional polymers in the unflavored section 115 are also permissible variations that allow tunable isolation of the flavorant-infused longitudinal regions 105 critical to preventing terpene burning and contamination of smoke while retaining intended flavors and aromas. Thus both passive and active filtration materials can comprise the unflavored section 115 housing.

Figure 2A:
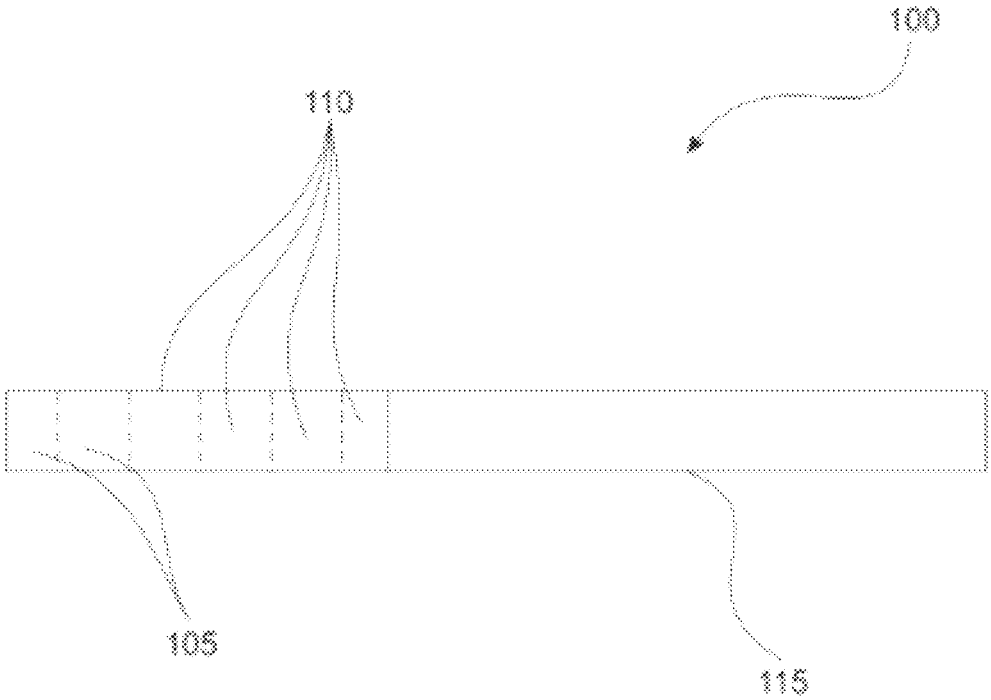
FIG. 2A illustrates a side view of an unfolded, unrolled embodiment of the present invention.

FIG. 2A depicts a side view of an unrolled improved tip 100 for a flavor infused smoking chamber of an embodiment of the present invention. The flavorant-infused longitudinal regions 105, barrier longitudinal regions 110 and unflavored section 115 are seen attached to each other along the same piece of paper in this embodiment. The sections may also be mounted on top of a secondary piece of paper to allow for easier construction. In this embodiment, the barrier longitudinal regions 110 is pre-formed as a composite laminated element that is subsequently adhered to the paper substrate using thermal or ultrasonic bonding techniques, ensuring a secure and continuous interface.

Figure 2B:
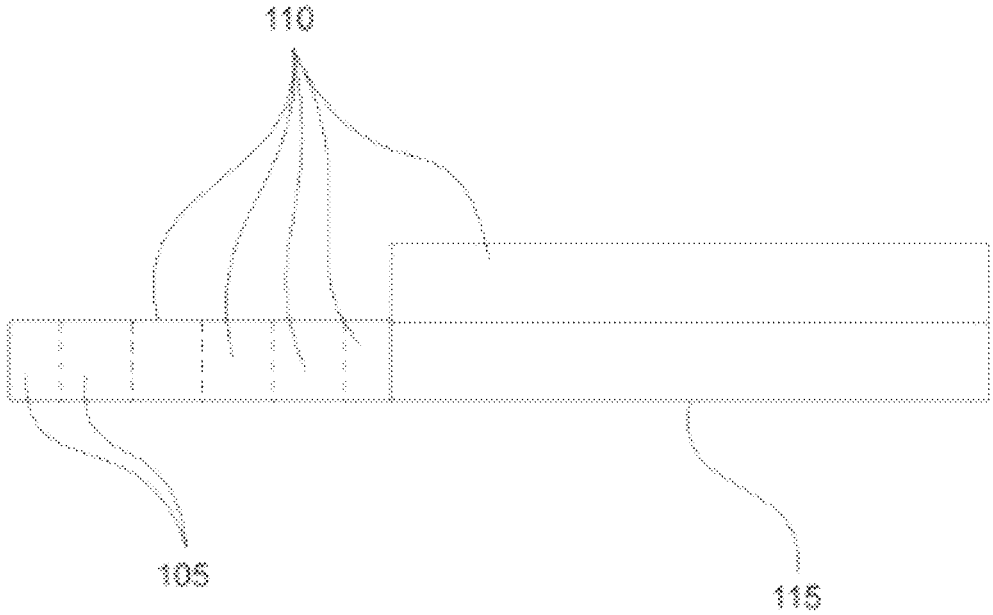
FIG. 2B illustrates a side view of an unfolded, unrolled embodiment of the present invention.

FIG. 2B depicts a side view of an unrolled improved tip 100 for a flavor infused smoking chamber of an embodiment of the present invention. The flavorant-infused longitudinal regions 105, and unflavored section 115 are seen attached to each other through the barrier longitudinal regions 110 in this embodiment. The barrier further is added above the flavorant-infused longitudinal regions 105 to assist in isolating it from the unflavored section 115. The sections may also be mounted on top of a secondary piece of paper to allow for easier construction. The barrier longitudinal regions 110 in this configuration may be applied using a lamination process that precisely aligns the composite barrier with the interface between the infused and uninfused sections, thereby minimizing the risk of flavorant bleeding.

Figure 2C:
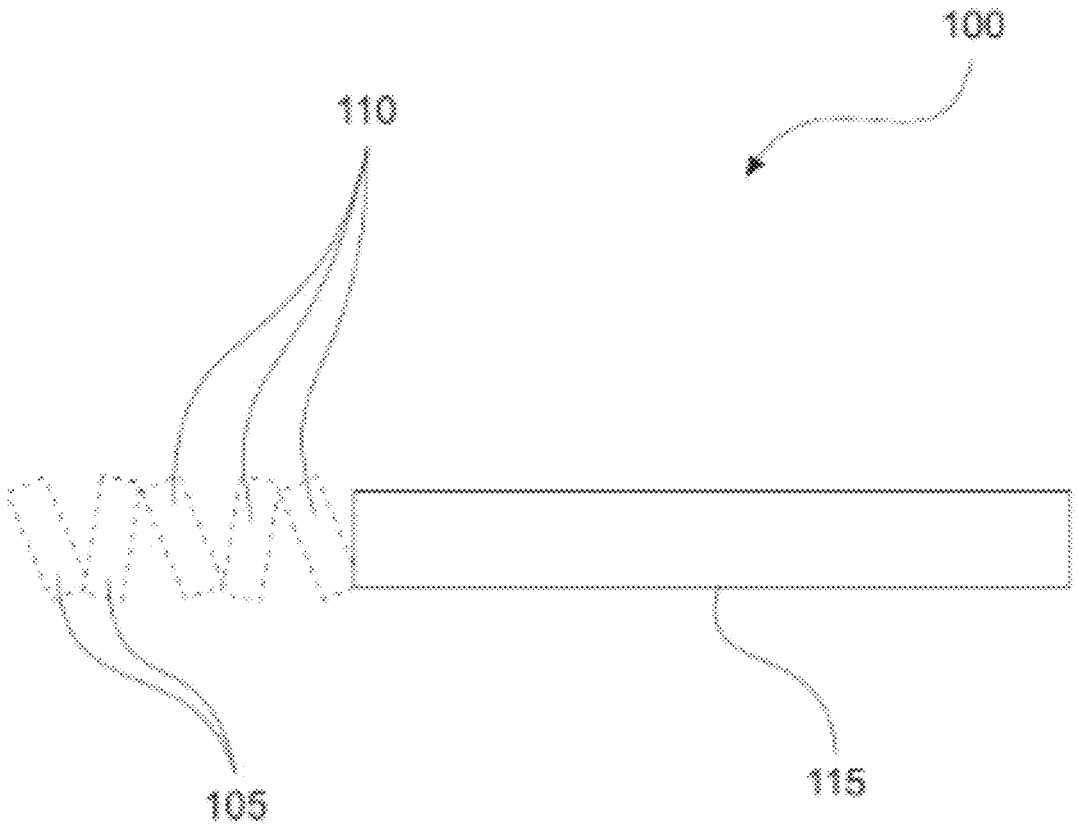
FIG. 2C illustrates a side view of a folded and unrolled embodiment of the present invention.

FIG. 2C depicts a side view of an unrolled improved tip 100 for a flavor infused smoking chamber of an embodiment of the present invention. The flavorant-infused longitudinal regions 105 and barrier longitudinal regions 110, are seen assembled from a series of accordion cut sections bound at the edges and corners. The unflavored section 115 is seen attached to the corner of the barrier longitudinal regions 110. The unflavored section 115 is formed as a sheet in this embodiment that has not been cut in an accordion style.

Figure 3A:
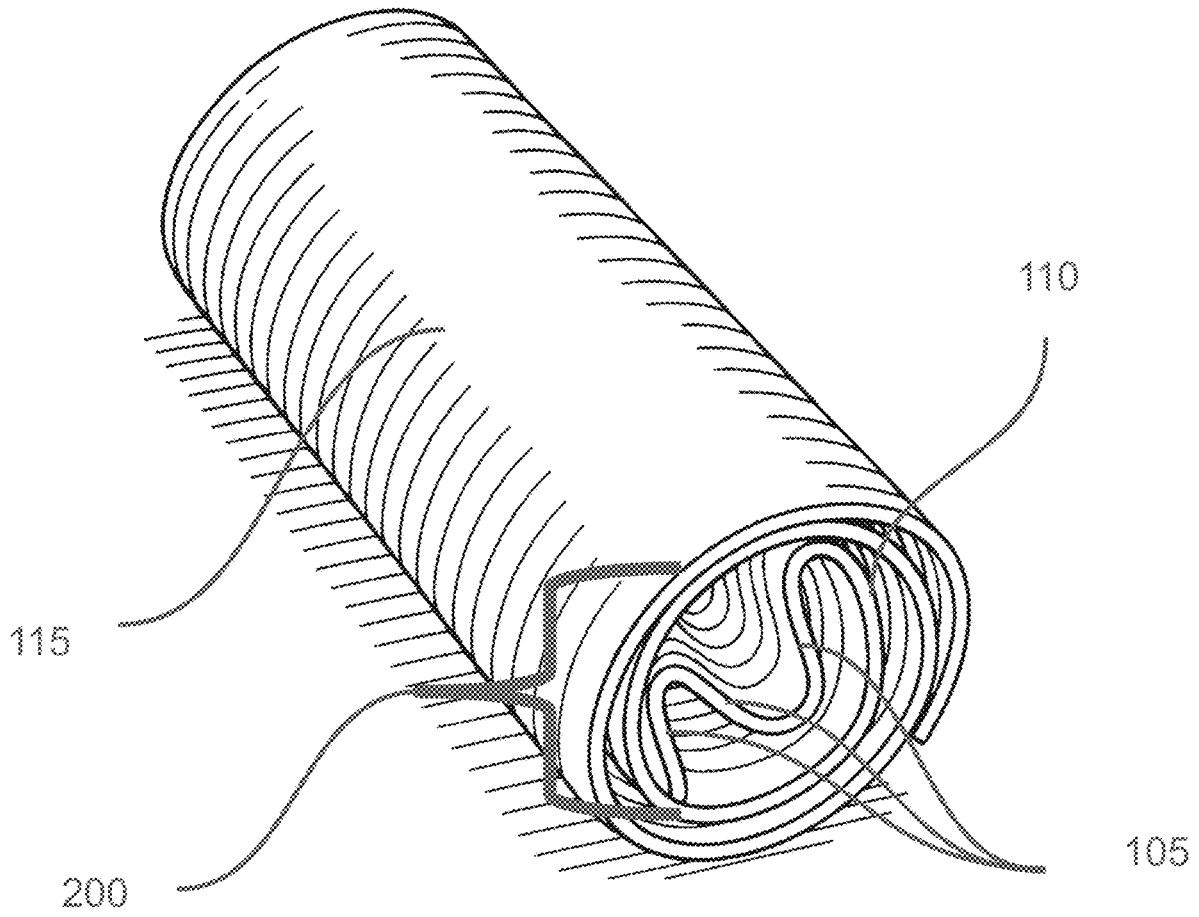
FIG. 3A illustrates a side view of the rolled embodiment of the present invention.

FIG. 3A depicts a side view of an rolled improved tip 100 for a flavor infused smoking chamber of an embodiment of the present invention. It can be seen in an exaggerated view that the central channel 200 forms an accordion shape due to the folded flavorant-infused longitudinal regions 105 and barrier longitudinal regions 110 sections. The remainder of the cross section is made of the unflavored section 115. The rolled configuration highlights the effectiveness of the barrier longitudinal regions 110 in maintaining the integrity of the flavorant within the central channel 200 despite the folding and mechanical stresses during assembly.

Figure 3B:
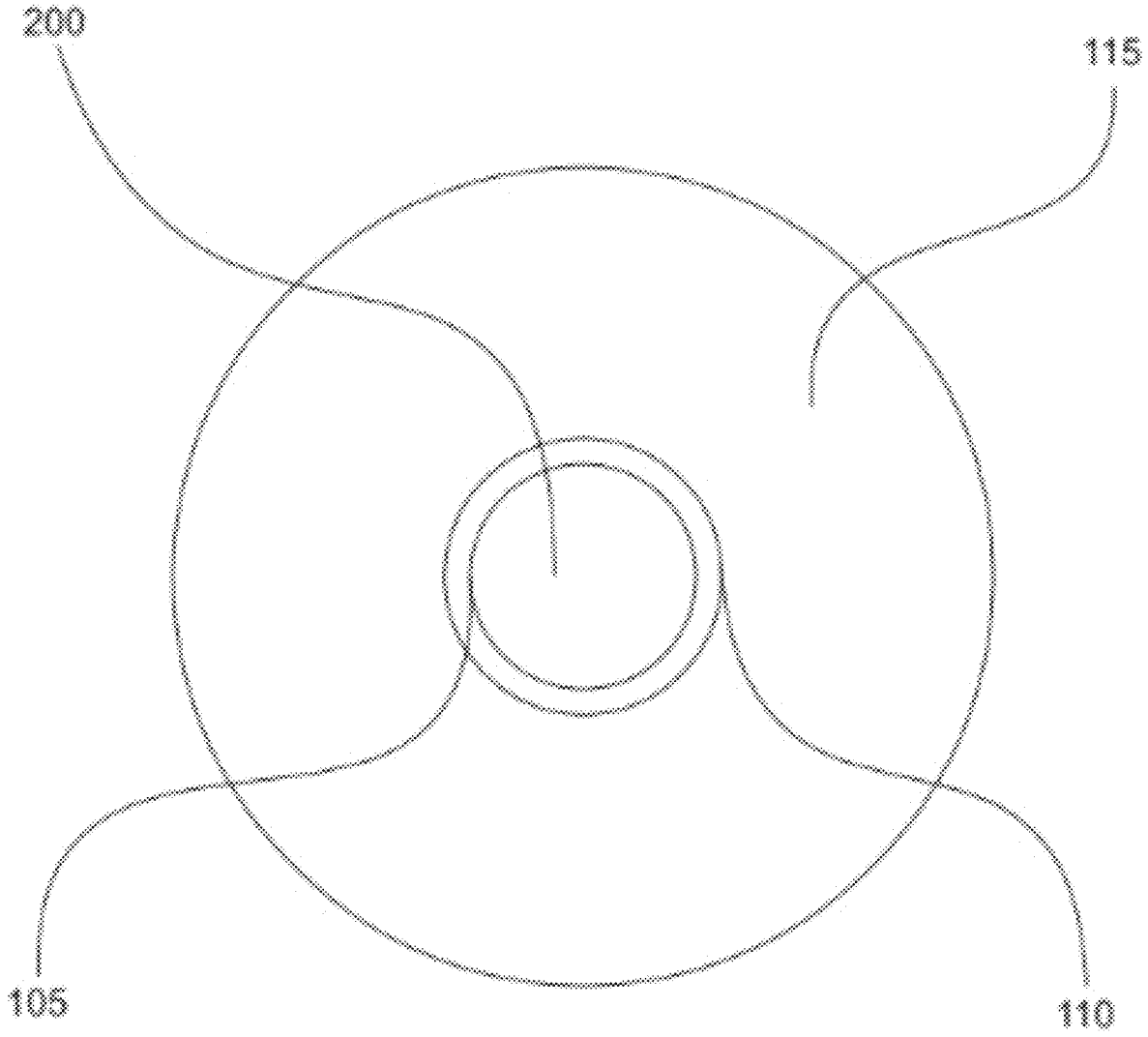
FIG. 3B illustrates a side view of the unrolled embodiment of the present invention.

FIG. 3B depicts a side view of an rolled improved tip 100 for a flavor infused smoking chamber of an embodiment of the present invention. It can be seen in an exaggerated view that the central channel 200 forms a circular shape due to the folded flavorant-infused longitudinal regions 105 and barrier longitudinal regions 110. The remainder of the cross section is made of the unflavored section 115. This embodiment further demonstrates the versatility of the barrier design, wherein the controlled perforations in barrier longitudinal regions 110 enable sufficient smoke passage to acquire the infused flavorant without compromising the separation of the infused and uninfused sections.

Method of Manufacture

A method of manufacturing the improved filter paper 100 is comprised of forming five arrays and perforations: creating five arrays along the length L of an elongated paper web, with perforations 104 that extend across the entire width W to delineate flavorant-infused longitudinal regions 105 and barrier longitudinal regions 110. Infusing the Flavored Arrays comprises applying a flavorant additive to arrays formed by via a pressure-injection technique. The infusion may be followed by drying or curing to stabilize the flavorant. Designating the Barrier Section: comprises leaving arrays formed by barrier longitudinal regions 110 unflavored and optionally bonding or laminating a composite interface (e.g., a non-porous polymer film plus hydrophobic paper) onto these arrays to further impede flavor migration. Ensuring Perforations Prevent Capillary Migration: comprises verifying that perforations 104 are placed so as to prevent lateral wicking of flavorant from flavorant-infused longitudinal regions 105 into arrays barrier longitudinal regions 110 or unflavored section 115. In some embodiments, laser etching or mechanical scoring may be used to achieve a desired perforation density.

In one embodiment, the method of manufacture involves first preparing the cylindrical filter body with designated infused and uninfused sections. The central channel 200 is infused with the selected flavorant additive via a pressure injection process, and then subjected to a curing step to stabilize the additive. A composite barrier longitudinal regions 110—comprising an inner non-porous polymer film and an outer hydrophobically-treated filter paper—is then pre-formed and precisely aligned with the interface between the infused central channel 200 and the unflavored sections 115. Using laser etching, controlled perforations are formed in the barrier section to allow for optimized smoke passage while preventing lateral diffusion of the flavorant. Finally, the composite barrier is bonded to the filter body via a lamination process selected from thermal or ultrasonic bonding, ensuring that the barrier maintains its structural integrity and separation function during both storage and use.

Additional Considerations

It should be noted that the number of arrays and perforations are illustrated in a preferred embodiment. But a variety of different number of arrays may be formed by a variety of different perforations may be formed without departing from the scope of the invention, as would be understood by a person of ordinary skill in the art.

As used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Some embodiments may be described using the expression "coupled" and "connected" along with their derivatives. For example, some embodiments may be described using the term "coupled" to indicate that two or more elements are in direct physical or electrical contact. The term "coupled," however, may also mean that two or more elements are not in direct contact with each other, but yet still co-operate or interact with each other. The embodiments are not limited in this context.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and Bis false (or not present), A is false (or not present) and Bis true (or present), and both A and B are true (or present).

In addition, use of the "a" or "an" are employed to describe elements and components of the embodiments herein. This is done merely for convenience and to give a general sense of the invention. This description should be read to include one or at least one and the singular also includes the plural unless it is obvious that it is meant otherwise.

Upon reading this disclosure, those of skill in the art will appreciate still additional alternative structural and functional designs for a system and a process for creating an interactive message through the disclosed principles herein. Thus, while particular embodiments and applications have been illustrated and described, it is to be understood that the disclosed embodiments are not limited to the precise construction and components disclosed herein. Various apparent modifications, changes and variations may be made in the arrangement, operation and details of the method and apparatus disclosed herein without departing from the spirit and scope defined in the appended claims.

What is claimed is:

1. A filter paper having a length and a width that can be rolled for forming a smoking tip in a hand-rolled smoking article, the filter paper comprising:

five longitudinal regions that are separated by perforations parallel to the width of the filter paper that extend continuously across the entire width of the filter paper, the longitudinal regions spanning across the entire width of the filter paper and a portion of the length of the filter paper;

two of the five longitudinal regions forming an infused section, the infused section being infused with a flavorant additive, the two infused longitudinal regions being adjacent to each other;

three of the five longitudinal regions forming a barrier section, the barrier section being unflavored, the three barrier longitudinal regions being adjacent to each other; and an unflavored section disposed adjacent to the barrier section on the filter paper such that the barrier section is disposed between the infused section and the unflavored section, whereby the perforations impede capillary action preventing the flavorant additive from migrating laterally from the flavored section into the unflavored section when the filter paper is in a un-rolled configuration, wherein the filter paper is folded at each perforation in opposing directions after each fold before being rolled into a smoking apparatus.

2. The filter paper of claim 1, wherein the flavorant additive is comprised of at least one of natural terpenes, synthetic food-grade flavorants, essential oils, and/or mixtures thereof.

3. The filter paper of claim 1, wherein the perforations are formed by laser etching to achieve a predetermined perforation density and pattern that balances the prevention of lateral capillary action with structural integrity.

4. The filter paper of claim 1, wherein the barrier section comprises a composite laminated interface having:

an inner non-porous polymer film layer, and an outer filter paper layer treated with a hydrophobic compound, configured to further impede the flavorant additive from migrating into the unflavored section.

5. The filter paper of claim 1, wherein the two infused longitudinal regions within the infused section are infused with the flavorant additive via a pressure-injection process and subsequently dried or cured to stabilize the flavorant additive.

6. The filter paper of claim 1, wherein the flavored section, barrier section, and unflavored section extend along the paper such that, when the paper is subsequently folded along each perforation and then rolled to form a cylindrical smoking tip, the flavored section forms an interior channel isolated from the outer combustible unflavored section by the barrier section.

7. A method of manufacturing a filter paper for forming a smoking tip in a hand-rolled smoking article, the method comprising:

providing an elongated paper web in an unrolled configuration having a length and a width;

forming five longitudinal regions of columns that span across the entire width of the filter paper and a portion of the length of the paper web, the five longitudinal regions being separated by perforations parallel to the width of the filter paper that extend continuously across the entire width of the paper web;

infusing two adjacent longitudinal regions of the paper web with a flavorant additive to form an infused section;

designating three adjacent longitudinal regions as a barrier section, said barrier section remaining unflavored and disposed between the infused section and an unflavored section on the paper web;

ensuring the perforations are sufficient to impede capillary action of the flavorant additive from migrating into the barrier section and the unflavored section; and folding the paper web along each perforation in opposing directions after each fold prior to rolling the filter paper into a smoking tip, whereby the perforations prevent the flavorant additive from migrating laterally from the infused section to the unflavored section when in the unrolled configuration.

8. The method of claim 7, further comprising pressure-injecting the flavorant additive into the two adjacent longitudinal regions and subsequently drying or curing the infused longitudinal regions to stabilize the flavorant additive prior to folding and rolling.

9. The method of claim 7, further comprising laminating at least a portion of the barrier section with a composite interface including a non-porous polymer film layer and a hydrophobically treated filter paper layer, thereby enhancing the barrier against flavorant migration.

10. The method of claim 7, wherein forming the perforations comprises laser etching the paper web to achieve a predetermined perforation pattern that balances structural integrity with the prevention of lateral flavorant migration.

* * * * *